US010119740B2

(12) United States Patent
Yang

(10) Patent No.: US 10,119,740 B2
(45) Date of Patent: Nov. 6, 2018

(54) REFRIGERATOR

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/455,765

(22) Filed: Mar. 10, 2017

(65) Prior Publication Data

US 2017/0292750 A1 Oct. 12, 2017

(30) Foreign Application Priority Data

Apr. 11, 2016 (KR) ..... 10-2016-0044323

(51) Int. Cl.

| | |
|---|---|
| ***F25C 1/24*** | (2018.01) |
| ***F25C 5/18*** | (2018.01) |
| ***F25C 5/06*** | (2006.01) |
| ***F25C 5/08*** | (2006.01) |
| ***F25C 5/182*** | (2018.01) |

(Continued)

(52) U.S. Cl.

CPC ..... *F25C 1/24* (2013.01); *F25B 5/02* (2013.01); *F25C 1/10* (2013.01); *F25C 1/22* (2013.01); *F25C 5/06* (2013.01); *F25C 5/08* (2013.01); *F25C 5/182* (2013.01); *F25C 5/22* (2018.01); *F25B 2600/2511* (2013.01);

(Continued)

(58) Field of Classification Search

CPC ..... F25B 1/24; F25B 5/06; F25B 5/08; F25B 5/22; F25B 1/10; F25B 1/22; F25B 2400/10; F25B 5/02; F25B 2600/2511; F25D 17/04; F25D 2323/024

USPC ..... 62/79, 335

See application file for complete search history.

(56) References Cited

U.S. PATENT DOCUMENTS 6,293,107 B1 * 9/2001 Kitagawa ..... F25B 21/02 62/3.2
2006/0130513 A1 * 6/2006 Chang ..... F25D 11/022 62/441

(Continued)

FOREIGN PATENT DOCUMENTS

EP 3001125 A1 3/2016
KR 10-0758325 B1 9/2007

(Continued)

OTHER PUBLICATIONS

Extended European Search Report dated Sep. 29, 2017 issued in corresponding European Patent Application No. 17165734.9.

*Primary Examiner* — Mohammad M Ali

(57) ABSTRACT

A refrigerator includes an ice-making unit disposed in the door and can make ice through direct cooling by a refrigerant without using cold air flow. A cold air generation system operates to circulate the refrigerant for supplying a cold air flow for the refrigerator. A refrigerant pipe is installed in the refrigerator main body to branch off some refrigerant from the cold air generation system. An ice-making pipe is installed within the ice-making unit and receives the refrigerant from the refrigerant pipe. Water freezes into ice through heat transfer between the ice-making unit and the ice-making pipe containing refrigerant. A soft pipe is disposed around a hinge shaft of the refrigerator main body and the door and configured to interconnect the ice-making pipe and the refrigerant pipe in a twistable manner.

13 Claims, 4 Drawing Sheets

(51) Int. Cl.

| | |
|---|---|
| ***F25B 5/02*** | (2006.01) |
| ***F25C 1/10*** | (2006.01) |
| ***F25C 1/22*** | (2018.01) |
| ***F25C 5/20*** | (2018.01) |
| *F25D 17/04* | (2006.01) |

(52) U.S. Cl.
CPC ..... *F25C 2400/10* (2013.01); *F25D 17/04* (2013.01); *F25D 2323/024* (2013.01)

(56) References Cited

U.S. PATENT DOCUMENTS

2006/0218961 A1* 10/2006 Kim ..... B67D 1/0858 62/344
2009/0260371 A1 10/2009 Kuehl et al.
2010/0011786 A1* 1/2010 Shin ..... F25C 1/04 62/73
2010/0242526 A1 9/2010 Junge et al.
2010/0251744 A1 10/2010 Yun et al.
2011/0051372 A1 3/2011 Barringer et al.
2011/0185760 A1* 8/2011 Suh ..... F25B 5/00 62/344
2012/0324919 A1* 12/2012 Bortoletto ..... F25C 1/20 62/73
2013/0174596 A1* 7/2013 Kim ..... F25C 1/04 62/320
2014/0157810 A1* 6/2014 Jang ..... F25D 23/126 62/129

FOREIGN PATENT DOCUMENTS

KR 10-2008-0015341 A 2/2008
KR 10-2009-0012687 2/2009
KR 10-2010-0113207 10/2010
KR 10-2012-0033536 4/2012
KR 10-2012-0060128 A 6/2012
WO 2009/017286 2/2009

* cited by examiner

REFRIGERATOR

CROSS-REFERENCE TO RELATED APPLICATION

This application is based on and claims priority from Korean Patent Application No. 10-2016-0044323, filed on Apr. 11, 2016, the disclosure of which is incorporated herein in its entirety by reference for all purposes.

TECHNICAL FIELD

The present disclosure relates to refrigerators, and more particularly, to ice makers in refrigerators.

BACKGROUND

In general, a refrigerator is an apparatus for storing various types of items, e.g., food, at low temperature. Low temperature in the refrigerator is achieved by circulating cold air that can be continuously generated through a heat exchange process by using a refrigerant. During operation, the refrigerant goes through repetitive cycles of compression, condensation, expansion and evaporation.

A main body of the refrigerator may have a rectangular parallel-piped shape with an open front surface. Typically, the main body encloses a refrigeration room or compartment and a freezer compartment, each with its own door. The refrigerator may include a plurality of drawers, shelves, vegetable compartments and the like for sorting and storing different types of items.

Conventionally, top mount type refrigerators were widely used, with a freezer compartment positioned at the upper side and a refrigeration compartment positioned at a lower side. Recently, the bottom freezer type refrigerators have been developed, where a freezer compartment is located at the lower side and a refrigeration compartment is located at the top. Because typically users access the refrigeration compartment more often than the freezer compartment, a bottom freezer type refrigerator allows a user to conveniently access the refrigeration compartment that is located at the upper portion of the refrigerator. Unfortunately, on the other hand, it can be inconvenient for a user to access the freezer compartment if the user often needs to lower or bend down to access the freezer compartment, e.g., for taking ice out of the freezer compartment.

Therefore, some bottom-freezer-type refrigerators are equipped with a dispenser for dispensing ice, e.g., ice cubes or crushed ice. The dispenser is typically located in a refrigeration compartment door. Accordingly, the ice-making device for producing ice may be installed in the refrigeration compartment door or the interior of the refrigeration compartment.

In a bottom-freezer-type refrigerator with an ice-making device installed in a refrigeration compartment door, a cold air flow produced by an evaporator can be supplied into the freezer compartment and the refrigeration compartment. In the freezer compartment, cold air flows toward the ice-making device along a cold air supply duct embedded in a sidewall of a refrigerator main body. Thus, the cold air freezes water into ice pieces while flowing through the interior of the ice-making device. The cold air is then discharged into the refrigeration compartment via a cold air return duct embedded in the sidewall of the refrigerator main body, thereby lowering the temperature in the refrigeration compartment.

However, in a conventional refrigerator, the cold air supply duct, the cold air return duct and a structure for insulating the ducts need to be mounted on the left or right wall surface portion of the refrigeration compartment. Unfortunately, these components occupy a lot of space and reduce the storage capacity of the refrigerator. They also tend to complicate the pipe arrangement inside the refrigerator.

Furthermore, ice pieces in the refrigerator door are produced by an indirect cooling process in which cold air flows through the cold air supply duct. Thus, water in the refrigerator door cannot be directly cooled by a refrigerant, and the ice-making rate is low.

SUMMARY

Embodiments of the present disclosure provide a refrigerator capable of making ice pieces within an ice-making compartment with enhanced efficiency.

In accordance with an aspect, there is provided a refrigerator including a refrigerator main body, a door, an ice-making unit, a cold air generation system, an ice-making pipe, a refrigerant pipe and a soft pipe. The refrigerator main body is configured to define an outer shell of the refrigerator. The door is configured to open and close an internal space of the refrigerator main body. The ice-making unit is provided in the door. The cold air generation system is configured to circulate a refrigerant so that cold air is supplied to the internal space. The ice-making pipe is installed within the ice-making unit so that the ice-making unit exchanges heat with the refrigerant. The refrigerant pipe is installed in the refrigerator main body to receive the refrigerant from the cold air generation system. The soft pipe is disposed around a hinge shaft of the refrigerator main body and the door and is configured to interconnect the ice-making pipe and the refrigerant pipe in a twistable manner.

The soft pipe may be configured to interconnect the ice-making pipe and the refrigerant pipe in an up-down direction of the door.

The refrigerant pipe may be branched from the cold air generation system so that an end portion of the refrigerant pipe is horizontally installed in a ceiling wall of the refrigerator main body.

The cold air generation system may include: an evaporator in which air exchanges heat with the refrigerant so that a cold air is supplied to the internal space of the refrigerator main body; a compressor configured to phase-change the refrigerant supplied from the evaporator to a gaseous refrigerant having a high temperature and high pressure; a condenser configured to phase-change the gaseous refrigerant to a liquid refrigerant having a high pressure; and an expansion valve configured to depressurize the liquid refrigerant and to supply the liquid refrigerant to the evaporator.

The ice-making unit may include: an ice-making compartment configured to provide an ice-making space; an ice-making tray configured to provide a frame which makes contact with the ice-making pipe so that ice pieces are produced through heat exchange with the refrigerant; and an ice bucket positioned under the ice-making tray to store the ice pieces.

The ice-making unit may further include: a heater disposed in a peripheral edge portion of the ice-making tray.

The refrigerator may further include: a pipe case configured to surround an end portion of the refrigerant pipe.

In accordance with another aspect, there is provided a refrigerator including a refrigerator main body, a door, an ice-making unit, a cold air generation system, an ice-making pipe, a refrigerant pipe and a soft pipe. The refrigerator main body is configured to define an outer shell of the refrigerator. The door is configured to open and close an internal space of the refrigerator main body. The ice-making unit is provided in the door. The cold air generation system is configured to circulate a refrigerant so that cold air is supplied to the internal space. The ice-making pipe is installed within the ice-making unit so that the ice-making unit exchanges heats with the refrigerant. The refrigerant pipe is branched from the cold air generation system so that an end portion of the refrigerant pipe is horizontally installed in a ceiling wall of the refrigerator main body. The soft pipe is configured to interconnect the ice-making pipe and the refrigerant pipe in a twistable manner.

The ice-making unit may include: an ice-making compartment configured to provide an ice-making space; an ice-making tray configured to provide a frame which makes contact with the ice-making pipe so that ice pieces are produced through heat exchange with the refrigerant; and an ice bucket positioned under the ice-making tray to store the ice pieces.

According to the embodiments of the present disclosure, the refrigerant in the refrigerator-main-body-side refrigerant pipe is supplied to the refrigerator-door-side ice-making pipe. Thus, the production of ice pieces in the refrigerator door may be performed by a direct cooling method using a refrigerant. As a result, it is possible to improve the cooling efficiency of ice pieces and to enhance the consumption efficiency of the energy consumed in a cooling process. In addition, it is possible to increase ice-making speed.

DETAILED DESCRIPTION

Figure 1:
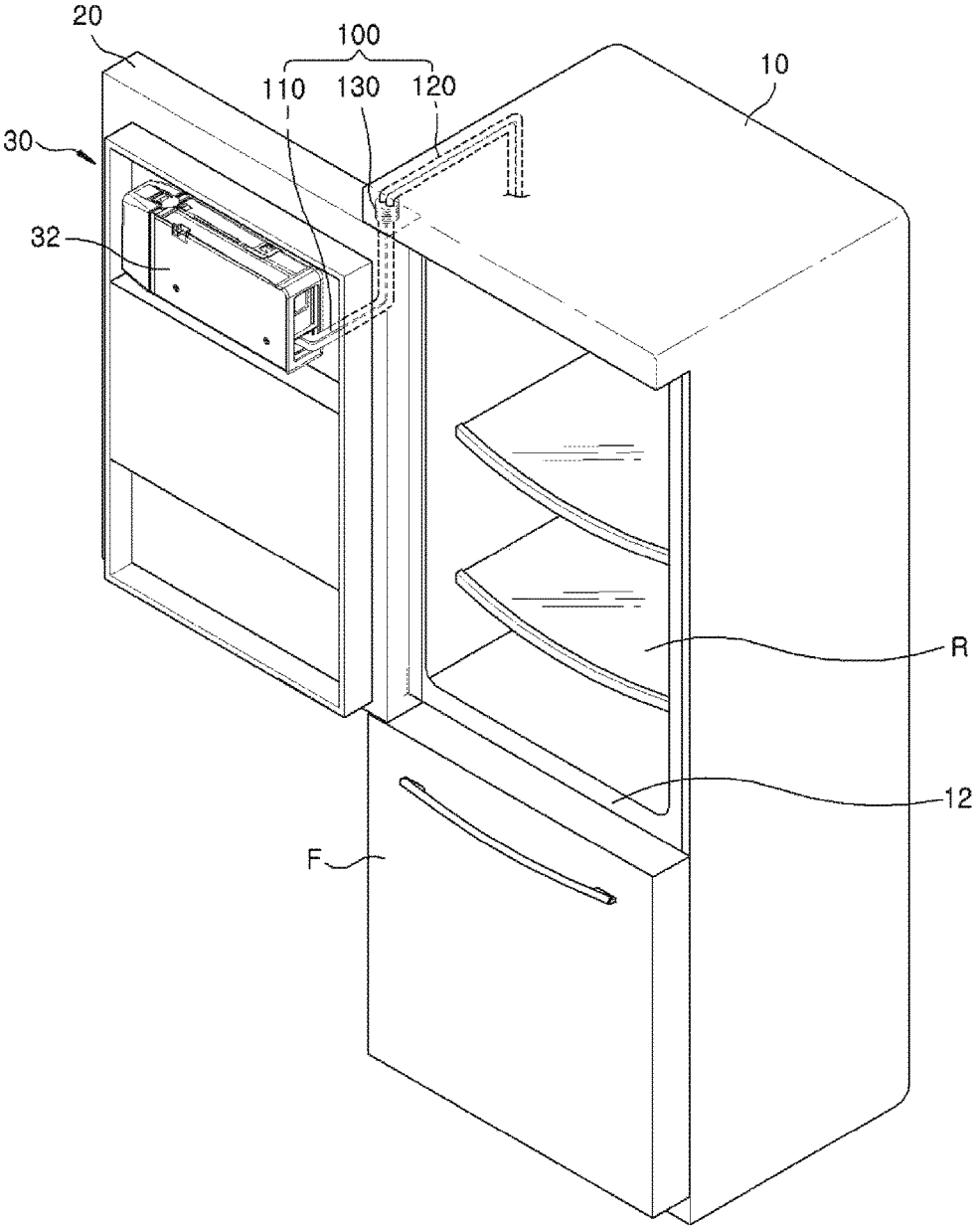
FIG. 1 is a perspective view illustrating an exemplary refrigerator according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is just exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
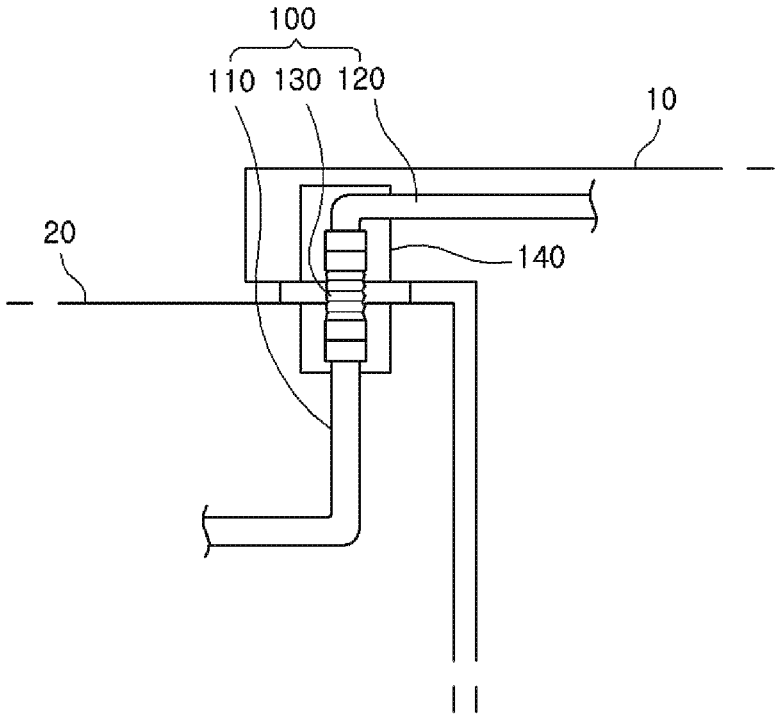
FIG. 2 is a view illustrating an exemplary coupling mechanism of an ice-making pipe, a refrigerant pipe and a soft pipe in the refrigerator according to one embodiment of the present disclosure.
Figure 3:
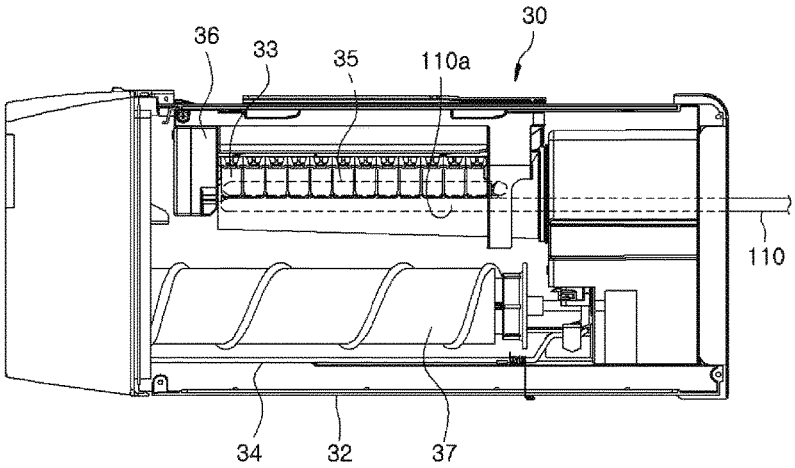
FIG. 3 is a side sectional view illustrating the internal configuration of an exemplary ice-making unit of the refrigerator illustrated in FIG. 1.
Figure 4:
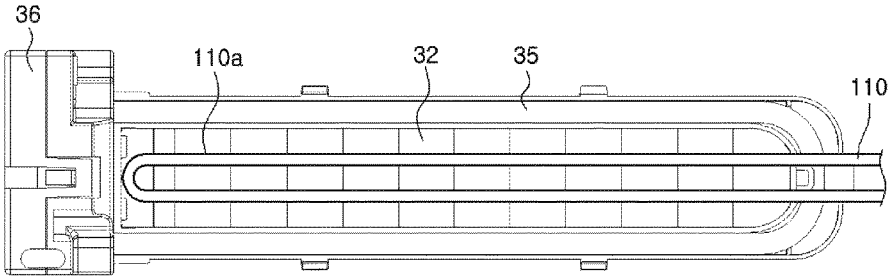
FIG. 4 is a plan view illustrating the internal configuration of an exemplary ice-making unit of the refrigerator illustrated in FIG. 1.
Figure 5:
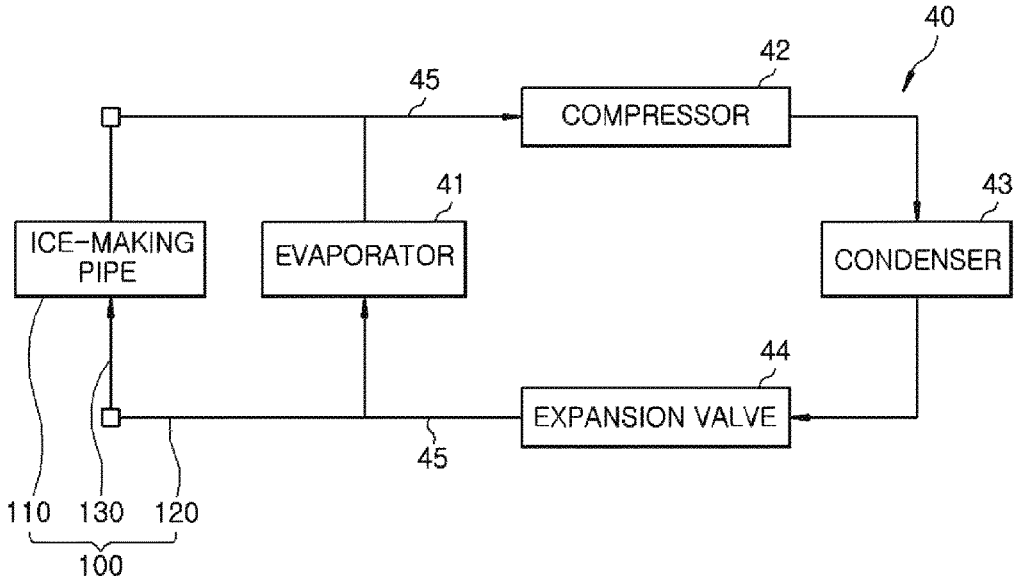
FIG. 5 is a block diagram illustrating an exemplary cold air generation system of the refrigerator according to one embodiment of the present disclosure.

FIG. 1 is a perspective view illustrating an exemplary refrigerator according to one embodiment of the present disclosure. FIG. 2 is a view illustrating an exemplary coupling mechanism of an ice-making pipe, a refrigerant pipe and a soft pipe in the refrigerator according to one embodiment of the present disclosure. FIG. 3 is a side sectional view illustrating the internal configuration of an exemplary ice-making unit of the refrigerator illustrated in FIG. 1. FIG. 4 is a plan view illustrating the internal configuration of an exemplary ice-making unit of the refrigerator illustrated in FIG. 1. FIG. 5 is a block diagram illustrating an exemplary cold air generation system of the refrigerator according to one embodiment of the present disclosure.

As illustrated in FIGS. 1 to 4, the refrigerator according to one embodiment of the present disclosure may include: a refrigerator main body 10 that defines an outer body of the refrigerator; a door 20 configured to seal an internal space of the refrigerator main body 10; an ice-making unit 30 disposed in the door 20; a cold air generation system 40 configured to circulate a refrigerant; and a direct cooling unit 100 configured to supply the refrigerant to the ice-making unit 130 via a twistable soft pipe 130.

More specifically, the refrigerator main body 10 is a housing configured to define an outer shell of the refrigerator and may be partitioned into a freezer compartment F and a refrigeration compartment R by a barrier 12. For example, the freezer compartment F may be disposed in a lower portion of the refrigerator main body 10 and the refrigeration compartment R may be disposed in an upper portion of the refrigerator main body 10. The freezer compartment F and the refrigeration compartment R may be covered by the door 20.

The door 20 may include a refrigeration compartment door configured to selectively seal the refrigeration compartment R, and a freezer compartment door configured to seal the freezer compartment F.

In the illustrated embodiment, a refrigeration compartment door bearing the ice-making unit 30 is configured to cover the refrigeration compartment R. However, the present disclosure is not limited by this configuration. The ice-making unit 30 may alternatively be disposed in the freezer compartment door. In addition, the refrigerator in this example is a bottom-freezer-type refrigerator. However, this implementation is merely exemplary and it will be appreciated that the present disclosure can be applied to various types of refrigerators.

The ice-making unit 30 may include: an ice-making compartment 32 configured to provide an ice-making space for producing ice pieces; an ice-making tray 33 configured to exchange heat with the refrigerant to produce ice pieces; an ice bucket 34 positioned under the ice-making tray 33; a rotary motor 36 configured to rotate the ice-making tray 33 to release the ice pieces from the ice-making tray 33 onto the ice bucket 34; and a heater 35 disposed in a peripheral edge portion of the ice-making tray 33.

The ice-making tray 33 is configured to provide a space in which the water received from a water supply pipe (not shown) is cooled into ice pieces. A plurality of cells capable of accommodating water may be formed on the upper surface of the ice-making tray 33. The cells may have any suitable shape. The number of cells may also be variable in different embodiments.

The ice-making tray 33 may be made of metal having high heat conductivity. The lower surface of the ice-making tray 33 may directly contact an ice-making pipe 110. The ice-making pipe 110 may have a U-shaped contact region 110*a*. For example, the contact region 110*a* of the ice-making pipe 110 may begin to extend from one end of the ice-making tray 33 and may be bent 180 degrees in the vicinity of the other end of the ice-making tray 33. Then, the contact region 110*a* may extend toward one end of the ice-making tray 33.

The present disclosure is not limited thereto. The contact region 110*a* of the ice-making pipe 110 may be bent multiple times and may have multiple depressions and protrusions on the lower surface of the ice-making tray 33. To enhance the heat transfer efficiency, the ice-making tray 33 and the ice-making pipe 110 may be bonded together by an adhesive agent or a fastener.

Thus, refrigerant supplied from the refrigerant pipe 120 to the ice-making pipe 110 can directly exchange heat with water contained in the ice-making tray 33 through the contact region 110*a* of the ice-making pipe 110. Thus, this cooling process is performed without relying on cold air as the intermediate cooling medium, as used in conventional refrigerators. Water thus cooled may transform into ice pieces. In this configuration, the contact region 110*a* of the ice-making pipe 110 may perform a cooling function in a manner that mimics a small evaporator in a freezing or cooling cycle for instance.

As described above, in the present embodiment, the ice pieces may be produced by a direct cooling method through heat exchange between the ice-making pipe 110 and the ice-making tray 33. In contrast, in the conventional art, cold air supplied from a refrigerator main body is supplied to an ice-making tray of an ice-making unit to produce ice pieces. This cooling process is an indirect cooling process as it involves gas-to-solid heat exchange between cold air and the ice-making tray 33. Thus, according to the present disclosure, the time required to produce a batch of ice pieces can be significantly and advantageously reduced.

Ice pieces thus produced may be pushed by the rotary motor 36 to the ice bucket 34 which is disposed under the ice-making tray 33. At this time, the heater 35 may heat the surface of the ice-making tray 33 briefly to slightly melt the surfaces of the ice pieces adhering to the ice-making tray 33. In this way, the ice pieces can be easily separated from the ice-making tray 33.

If the upper surface of the ice-making tray 33 is rotated toward the ice bucket 34, the ice-making tray 33 is twisted at a predetermined angle or more. Due to the twisting force, the ice pieces accommodated in the ice-making tray 33 may be dropped into the ice bucket 34. The ice pieces stacked in the ice bucket 34 are supplied between blades of an auger 37. When the auger 37 is rotated, the ice pieces may be supplied to a user through a dispenser (not shown) disposed in the door 20.

The direct cooling unit 100 may include the ice-making pipe 110 installed in the ice-making unit 30, a refrigerant pipe 120 installed in the refrigerator main body 10, a soft pipe 130 configured to flexibly interconnect the ice-making pipe 110 and the refrigerant pipe 120, and a pipe case 140 configured to surround an end portion of the refrigerant pipe 120.

The ice-making pipe 110 may be installed in the ice-making compartment 32 so that at least a portion (e.g., the contact region 110*a*) of the ice-making pipe 110 makes contact with the ice-making tray 33 of the ice-making unit 30. Thus, the refrigerant supplied to the ice-making pipe 110 may rapidly cool the water by directly exchange heat with the water contained in the ice-making tray 33, through the contact region 110*a* of the ice-making pipe 110.

The refrigerant pipe 120 is a pipe branched from a refrigerant line 45 of the cold air generation system 40. The refrigerant pipe 120 may be branched from the cold air generation system 40 so that the end portion of the refrigerant pipe 120 is horizontally installed in a ceiling wall of the refrigerator main body 10. The refrigerant pipe 120 may include an inflow refrigerant pipe configured to supply the refrigerant from the cold air generation system 40 to the ice-making pipe 110 and an outflow refrigerant pipe configured to return the refrigerant from the ice-making pipe 110 to the cold air generation system 40.

The refrigerant pipe 120 is coupled to the ice-making pipe 110 via the soft pipe 130. The refrigerant pipe 120 can supply the refrigerant from the cold air generation system to the ice-making pipe 110 as well as return the refrigerant from the ice-making pipe 110 to the cold air generation system 40. Thus, the refrigerant supplied from the refrigerant line 45 to the refrigerant pipe 120 may flow toward the ice-making pipe 110 via the soft pipe 130 and may cool the ice-making unit 30. Thereafter, the refrigerant may flow toward the refrigerant line 45 via the soft pipe 130 and the ice-making pipe 110.

The soft pipe 130 may be a refrigerant hose configured to interconnect the ice-making pipe 110 and the refrigerant pipe 120 along the up-down direction of the door 20 and in a region around a hinge shaft of the refrigerator main body 10 and the door 20. For example, the soft pipe 130 may be a refrigerant hose made of a twistable flexible material and may be fastened to the end portions of the ice-making pipe 110 and the refrigerant pipe 120 by bolts.

In some embodiments, the soft pipe 130 is manufactured in a four-layer structure including an outer rubber layer, a reinforcing layer, an inner rubber layer and a resin layer (nylon layer). Thus, the soft pipe 130 may reduce loss of cold air and may effectively deliver the refrigerant from the refrigerant pipe 120 installed in the refrigerator main body 10 to the ice-making pipe 110 installed in the door 20. The soft pipe 130 does not interfere with the motion of the door 20.

The pipe case 140 is a case configured to protect the end portion of the refrigerant pipe 120. A foam material such as urethane foam or the like may be filled in the pipe case 140 and used for heat insulation. Since the pipe case 140 is configured to shield a fastening portion between the refrigerant pipe 120 and the soft pipe 130, the unwanted view of the fastening portion is hidden. A case cover (not shown) for opening and closing an internal space may be installed in the pipe case 140.

FIG. 5 is a block diagram illustrating the cold air generation system of the refrigerator according to one embodiment of the present disclosure.

As illustrated in FIG. 5, the cold air generation system 40 may supply a cold air flow to the refrigeration compartment and the freezer compartment. The cold air flow is generated through heat exchange between the refrigerant and air inside a cooling duct (not shown).

The cold air generation system 40 may include: an evaporator 41: a compressor 42 configured to transform the refrigerant discharged from the evaporator 41 to a gaseous phase having high temperature and high pressure; a condenser 43 configured to transform the gaseous refrigerant to a liquid phase having a high pressure; and an expansion valve 44 configured to adiabatically expand the liquid refrigerant and to supply the expanded liquid refrigerant to the evaporator 41.

Thus, a cooling cycle, including compression, condensation, expansion and evaporation of the refrigerant, is performed by the compressor 42, the condenser 43, the expansion valve 44 and the evaporator 41 in combination. As a result, air in the cooling duct may be cooled to cold air through heat exchange with the refrigerant of the evaporator 41. The compressor 42, the condenser 43 and the expansion valve 44 may collaborate to supply the refrigerant to the direct cooling unit 100.

Thus, part of the refrigerant may be used to generate and supply a cold air to the freezer compartment and the refrigeration compartment while circulating through the cooling cycle performed by the evaporator 41, the compressor 42, the condenser 43 and the expansion valve 44 along the refrigerant line 45. Another part of the refrigerant may be diverted to the ice-making pipe 110 through the refrigerant pipe 120 and used to cool the ice-making unit 30. This part of refrigerant may be circulated through the cooling cycle performed by the evaporator 41, the compressor 42, the condenser 43 and the expansion valve 44.

Hereinafter, exemplary operations and functions of the exemplary refrigerator are described.

First, if a part of the refrigerant participating the cooling cycle of the refrigerator is diverted from the refrigerant line 45 to the refrigerant pipe 120, the refrigerant in the refrigerant pipe 120 may flow toward the ice-making pipe 110 through the soft pipe 130. The soft pipe 130 may be made of a material which can be extended and contracted when the door 20 opens and closes. Thus, the refrigerant can flow between the refrigerant pipe 120 and the ice-making pipe 110 without being restricted or obstructed by the motion of the door 20.

The refrigerant flowing in the ice-making pipe 110 may directly cool the ice-making tray 33 through the contact region 110*a*. At this time, water supplied to the ice-making tray 33 is directly cooled by the contact region 110*a* and is consequently transformed to ice. In this manner, ice pieces may be produced rapidly after water is introduced to the ice-making tray 33. Ice pieces produced in the ice-making tray 33 may be dropped onto the ice bucket 34 disposed under the ice-making tray 33 and, then, may be supplied to a user through the dispenser of the door 20.

The refrigerant in the ice-making pipe 110, which has exchanged heat with the ice-making tray 33, may flow back to the refrigerant pipe 120 through the soft pipe 130 and participate the cooling cycle of the refrigerator.

As described above, according to the present disclosure, the ice pieces are produced using the cold air directly cooled in the cooling duct. It is therefore advantageously possible to enhance the cooling efficiency of the ice pieces and the supply efficiency of the cold air. The cold air is circulated through a short route between the cooling duct and the ice-making space of the refrigerator door. It is therefore possible to effectively reduce loss of cold air. As a consequence, it is possible to reduce power consumption required during operation of the refrigerator.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only exemplary in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator comprising:

an ice-making unit configured to receive water;

a cold air generation system configured to circulate a refrigerant and produce cold air through heat exchange between the refrigerant and air in the refrigerator;

an ice-making pipe disposed proximate to the ice-making unit so that the ice-making unit exchanges heat with the refrigerant flowing in the ice-making pipe, wherein a part of the ice-making pipe is installed within the ice-making unit;

a refrigerator main body serving as a housing of the refrigerator;

a door coupled to the refrigerator main body, wherein the ice-making unit is disposed in the door;

a refrigerant pipe installed in the refrigerator main body, wherein the refrigerant pipe is configured to receive the refrigerant from the cold air generation system, and a soft pipe disposed around a hinge shaft that couples the refrigerator main body and the door, wherein the soft pipe is a bellows pipe, which is fastened to an end portion of the ice-making pipe and an end portion of the refrigerant pipe by bolts and extends along an up-down axis of the door to withstand twisting deformation around the hinge shaft.

2. The refrigerator of claim 1, wherein the refrigerant in the ice-making pipe is operable to exchange heat with the ice-making unit directly without using air as an intermediate.

3. The refrigerator of claim 1, wherein the ice-making pipe directly contacts the ice-making unit.

4. The refrigerator of claim 1, wherein the refrigerant pipe is branched from the cold air generation system, and wherein the end portion of the refrigerant pipe is horizontally installed in a top wall of the refrigerator main body.

5. The refrigerator of claim 1, wherein the cold air generation system comprises:

an evaporator;

a compressor;

a condenser; and an expansion valve.

6. The refrigerator of claim 1, wherein the ice-making unit comprises:

an ice-making compartment configured to provide an ice-making space;

an ice-making tray directly contacting the ice-making pipe; and an ice bucket positioned under the ice-making tray and configured to store ice pieces.

7. The refrigerator of claim 6, wherein the ice-making unit further includes a heater disposed in a peripheral edge portion of the ice-making tray.

8. The refrigerator of claim 1 further comprising:

a pipe case configured to cover the end portion of the refrigerant pipe.

9. The refrigerator of claim 1, wherein the soft pipe is formed in a four-layer structure including an outer rubber layer, a reinforcing layer, an inner rubber layer and a resin layer.

10. A refrigerator comprising:

a refrigerator main body defining an outer body of the refrigerator;

a door coupled to the refrigerator main body;

an ice-making unit disposed in the door;

a cold air generation system configured to circulate a refrigerant and produce a cold air flow for circulation in the refrigerator;

an ice-making pipe having a part installed within the ice-making unit so that the ice-making unit exchanges heat with the refrigerant flowing in the ice-making pipe;

a refrigerant pipe branched from the cold air generation system, and configured to supply the refrigerant to the ice-making pipe; and a soft pipe disposed around a hinge shaft that couples the refrigerator main body and the door, wherein the soft pipe is a bellows pipe, which is fastened to an end portion of the ice-making pipe and an end portion of the refrigerant pipe by bolts and extends along an up-down axis of the door to withstand twisting deformation around the hinge shaft.

11. The refrigerator of claim 10, wherein the end portion of the refrigerant pipe is horizontally installed in a top wall of the refrigerator main body.

12. The refrigerator of claim 10, wherein the ice-making unit comprises an ice-making compartment configured to provide an ice-making space;

an ice-making tray configured to contact the ice-making pipe; and an ice bucket positioned under the ice-making tray to store ice pieces.

13. The refrigerator of claim 10, wherein the soft pipe is formed in a four-layer structure including an outer rubber layer, a reinforcing layer, an inner rubber layer and a resin layer.

* * * * *